US007334697B2

(12) United States Patent
Myers et al.

(10) Patent No.: US 7,334,697 B2
(45) Date of Patent: Feb. 26, 2008

(54) ISO CONTAINER

(75) Inventors: Gerald D. Myers, Fairbanks, AK (US); Paul Steinert, Winchester, CA (US)

(73) Assignee: Alkan Shelter, LLC, Fairbanks, AK (US)

( * ) Notice: Subject to any disclaimer, the term of this patent is extended or adjusted under 35 U.S.C. 154(b) by 0 days.

(21) Appl. No.: 11/254,343

(22) Filed: Oct. 20, 2005

(65) Prior Publication Data

US 2006/0081628 A1 Apr. 20, 2006

Related U.S. Application Data

(60) Provisional application No. 60/620,648, filed on Oct. 20, 2004.

(51) Int. Cl.
*B65D 88/00* (2006.01)

(52) U.S. Cl. ..... 220/1.5; 220/635

(58) Field of Classification Search ..... 220/1.5, 220/628, 635, 661, 676
See application file for complete search history.

(56) References Cited

U.S. PATENT DOCUMENTS

| | | | | |
|---|---|---|---|---|
| 3,620,277 | A | | 11/1971 | Tummarello |
| 3,861,106 | A | | 1/1975 | Erhart |
| 3,932,946 | A | | 1/1976 | Johnson |
| 4,173,856 | A | | 11/1979 | Fricker et al. |
| 4,231,709 | A | | 11/1980 | Corsetti |
| 4,722,155 | A | | 2/1988 | Ericsson et al. |
| 4,743,485 | A | | 5/1988 | Ting |
| 4,833,841 | A | | 5/1989 | Ellington, III |
| 4,940,252 | A | | 7/1990 | Seib |
| 5,186,330 | A | | 2/1993 | McClure |
| 5,193,325 | A | | 3/1993 | Allison |
| 5,257,440 | A | | 11/1993 | Bardou et al. |
| 5,285,604 | A | | 2/1994 | Carlin |
| 5,603,472 | A | * | 2/1997 | Hutter, III ..... 244/132 |
| 5,678,715 | A | * | 10/1997 | Sjostedt et al. ..... 220/1.5 |
| 5,688,086 | A | * | 11/1997 | Menzemer et al. ..... 410/68 |
| 5,761,854 | A | * | 6/1998 | Johnson et al. ..... 52/69 |
| 5,810,186 | A | * | 9/1998 | Lam ..... 220/1.5 |
| 5,830,548 | A | * | 11/1998 | Andersen et al. ..... 428/36.4 |
| 5,979,684 | A | | 11/1999 | Ohnishi et al. |
| 6,012,598 | A | | 1/2000 | Antoniou |
| 6,023,891 | A | | 2/2000 | Robertson et al. |
| 6,338,513 | B1 | | 1/2002 | Williams |
| 6,345,472 | B1 | | 2/2002 | Taylor |
| 2002/0164911 | A1 | * | 11/2002 | Cunningham et al. ..... 442/135 |

OTHER PUBLICATIONS

International Searching Authority Search Report, May 11, 2005, International Application No. PCT/US04/20583.
Written Opinion of the International Searching Authority, May 11, 2005, International Application No. PCT/US04/20583.

* cited by examiner

*Primary Examiner*—Anthony D. Stashick
*Assistant Examiner*—Harry A Grosso
(74) *Attorney, Agent, or Firm*—Locke Lord Bissell & Liddell LLP

(57) ABSTRACT

A lightweight transportable container is disclosed in which the wall, roof, and floor of the container are laminated panels bonded together to form a rigid monolithic structure. The container is formed of nonmetallic materials, is stackable, and has a payload more than eight times greater than the tare weight of the container. The container is particularly useful in hostile and extreme temperature environments and is designed to withstand the application of numerous forces from various directions, such as those typically applied, for example, in ISO certification testing.

20 Claims, 15 Drawing Sheets

ISO CONTAINER

CROSS-REFERENCE TO RELATED APPLICATION

This application for patent claims priority to, and hereby incorporates by reference, U.S. Provisional Application No. 60/620,648, entitled "ISO Shelter," filed Oct. 20, 2004, with the United States Patent and Trademark Office.

COPYRIGHT NOTICE

A portion of the disclosure of this patent document contains material which is subject to copyright protection. The copyright owner has no objection to the facsimile reproduction of the patent disclosure, as it appears in the Patent and Trademark Office patent files or records, but otherwise reserves all copyright rights whatsoever.

BACKGROUND OF THE INVENTION

1. Technical Field

This invention relates generally to transportable shelters and containers (hereinafter "containers") and, more particularly, to containers that satisfy international and military standards and regulations regarding stackability, including International Standards Organization (ISO), Container Safety Convention (CSC), and Coast Guard Certification (CGC) standards.

2. History of the Related Art

Containers suitable for transportation by truck, ship, or air must generally comply with the standards and regulations for ship freight set forth by ISO and CSC. Furthermore, containers that are transported by helicopter must be able to support the dynamic load imposed by the lifting of the containers, which is typically about three times the static load. Heretofore, such containers generally have a metal framework, i.e., a post-and-beam construction, with composition board (usually steel or aluminum sheathed) or other composite material panels attached to the framework by bolts, rivets, welding, and the like. Such containers, however, are inherently heavy. For example, a standard 20-feet long container constructed to meet ISO size requirements (typically 8 feet wide by 8 feet high) weighs on the order of 4,000 to 5,000 pounds. As a result, the maximum cargo or payload that can be transported in such a container is generally limited to two to three times the tare weight, or empty weight, of the container. Furthermore, the side, roof, and floor panels of the metal-framed container typically do not support any structural loads or provide any structural resistance to externally applied forces. The metal framework of these containers must therefore have sufficient mass and structural strength to support both the cargo load and any externally applied forces.

Metal-framed and paneled containers also have different thermal expansion characteristics for the various materials used in the construction of the containers. Metal framework typically expands or contracts at a rate that is different than the expansion or contraction rate of the panels. This difference in thermal expansion characteristics is particularly significant in extreme temperature environments where the joints between the panels and the metal frame can become stressed or cracked, permitting the entrance of moisture and water into the joints. Also, for panels having metal surfaces, the surfaces tend to expand and contract at a rate that is different from the rate of the underlying core, resulting in delamination of the panels.

More recently, instead of metal framework, some transportable containers that have been constructed to meet ISO size requirements have been formed of composite material panels. However, clips or other fastening means must be used to hold these composite material panels in their respective relative positions. For example, U.S. Pat. No. 5,285,604, issued Oct. 10, 1991 to Kevin Carlin, discloses a mobile kitchen formed of composite material walls that is assembled from modular components and then held together by rivets extending through aluminum bolsters bridging one or more of the components. However, as stated in this patent, while the aluminum rivet bolster strips are advantageous for securing the riveted connections between panels, they do not provide substantial additional rigidity, support, or structural strength for the panels. Thus, the Carlin structure is inherently incapable of supporting or resisting vertically or transversely applied forces of any significant magnitude. In other words, the structure is not stackable, i.e., it cannot support another similar unit stacked on top of it and is inherently weak in resisting transversely applied loads.

It would be desirable to be able overcome the problems set forth above. In particular, it would be desirable to have a transportable container constructed of lightweight materials in which the walls, roof, and floor of the container are structural load bearing members that also have similar coefficients of expansion. It would also be desirable to have such a container that has a payload capability greater than eight to nine times its tare weight. Furthermore, it would be desirable to have a container that is capable of providing a barrier to electromagnetic signals, or, alternatively, can be constructed of a material that is not reflective of radar energy. It is also desirable to have a container that is capable of being pressurized and maintained at a positive pressure atmosphere to prevent the infiltration of hazardous, toxic, or otherwise undesirable atmospheres, or for high altitude applications.

BRIEF SUMMARY OF THE INVENTION

The present invention provides a lightweight transportable container in which the wall, roof, and floor are structural load bearing members. This allows the container to be stackable and have a payload capacity more than eight times greater than the tare weight of the container. The walls, roof, and floor are composed of nonmetallic laminated panels bonded together and having the same or similar coefficients of expansion. This makes the container particularly useful, for example, as a shelter in hostile and extreme temperature environments. The container is also designed to withstand the application of numerous forces in various directions, such as those typically used, for example, in ISO certification testing. In some embodiments, the container is capable of providing a barrier to electromagnetic signals or, alternatively, may be constructed of a material that is not reflective of radar energy. In some embodiments, the container is capable of being pressurized and maintained at a positive pressure atmosphere to prevent the infiltration of hazardous, toxic, or otherwise undesirable atmospheres, or for high altitude applications.

In accordance with one aspect of the invention, a container according to embodiments of the invention includes a plurality of nonmetallic columns having a length substantially equal to the height of the container and a plurality of nonmetallic wall panels, each of which has a first and a second vertical end that is respectively bonded to a separate one of the nonmetallic columns.

Each of the wall panels also has bottom and top edges that extend respectively between the first and second vertical ends of each of the panels. The container also includes a nonmetallic laminated floor panel having a plurality of edges that intersect at predefined corners. Each of the floor panel edges is integrally bonded with the bottom edge of a respective one of the wall panels and with one of the nonmetallic columns at each of the predefined corners of the floor panel. The container also includes a nonmetallic roof panel having a plurality of edges intersecting at predefined corners, with each of the edges being integrally bonded with the top edge of a respective one of the nonmetallic wall panels and with a respective one of the nonmetallic columns at each of the predefined corners of the roof panel.

In another aspect of the invention, a container for extreme weather environments has a plurality of nonmetallic columns, each of which are disposed at a predefined vertical edge corner of the container. A plurality of nonmetallic wall panels has predefined top, bottom, and end edge surfaces. Each of the end edge surfaces of the wall panels is integrally bonded with one of the nonmetallic vertical columns. A nonmetallic roof panel has edge portions that are integrally bonded to the top edge surface of each of the wall panels and with the vertical columns. A nonmetallic floor panel also has edge portions that are integrally bonded with the bottom edge surface of each of the wall panels and with the vertical columns. The nonmetallic vertical columns, the nonmetallic wall panels, the nonmetallic roof panel, and the nonmetallic floor panel, form a unitary monocoque structure in which the vertical columns, wall panels, and roof and floor panels are all structural load bearing elements and cooperate with each other to distribute forces imposed on the container.

In still other aspects of the invention, a floor brace and stiffeners may be attached to the floor panel of the container to reinforce the floor panel against twisting and/or flexing during shipping. Similarly, a roof brace may be mounted to the roof and the front wall of the container to further reinforce the container and to provide protection from routine physical contact, such as from logistics handling equipment.

DETAILED DESCRIPTION OF THE INVENTION

Figure 1:
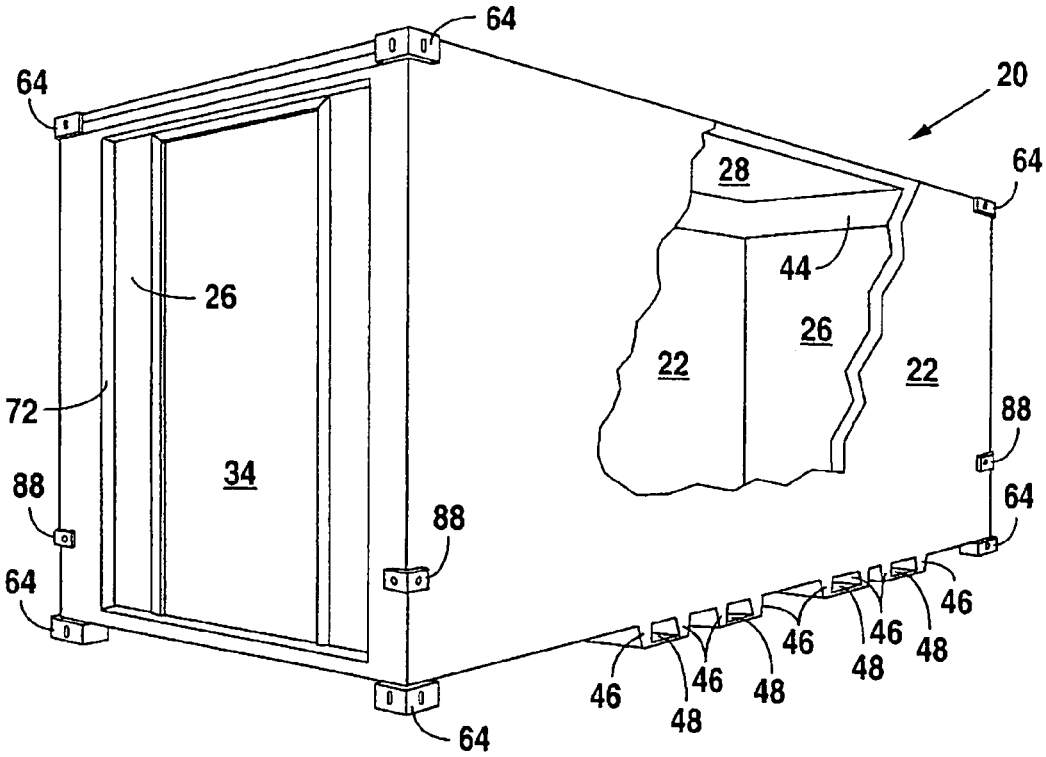
FIG. 1 is a perspective view of a container according to one embodiment of the invention in which a portion of a non-removable side wall of the container is cut away to show other details.
Figure 2:
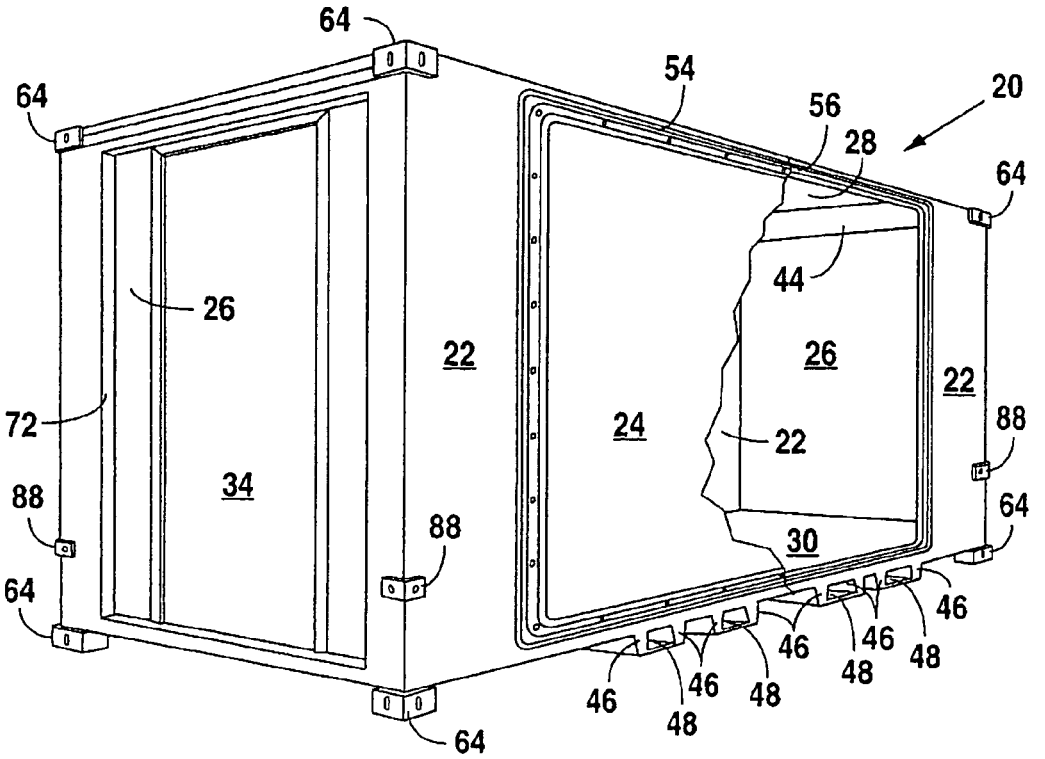
FIG. 2 is a perspective view of the container according to one embodiment of the invention in which a removable panel in the side wall of the container is cut away to show other details.
Figure 3:
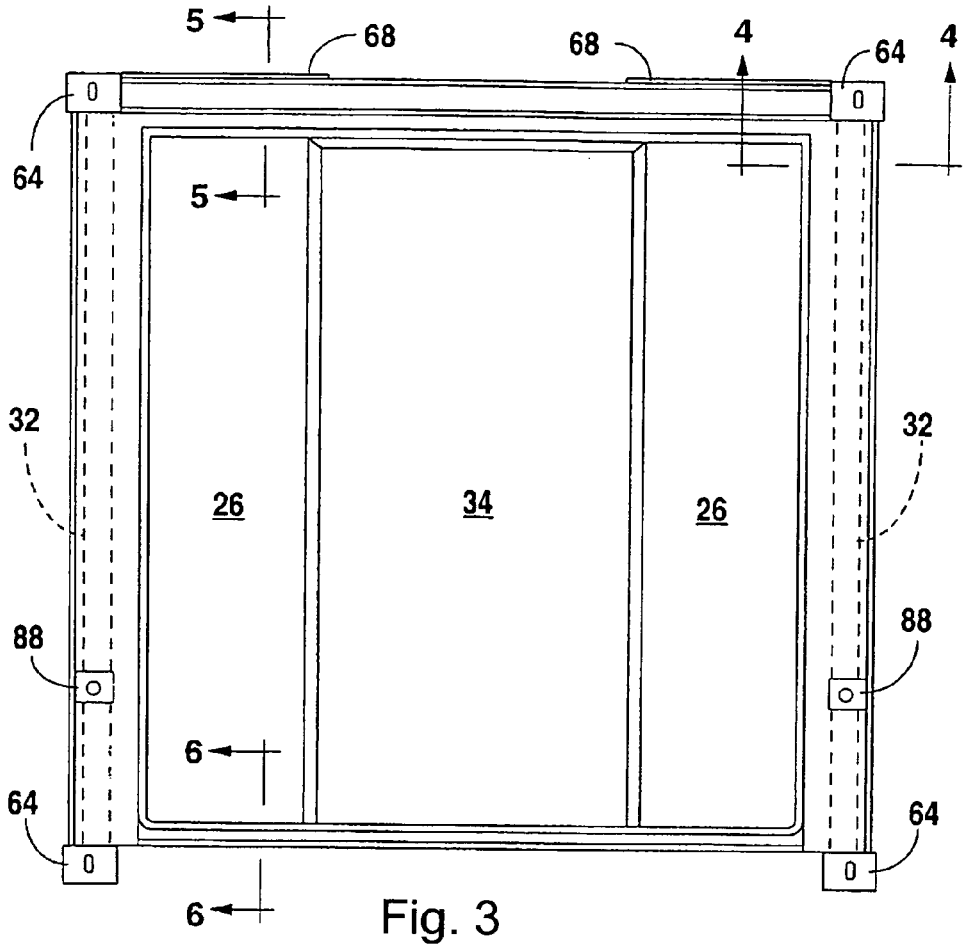
FIG. 3 is an end view of the container according to one embodiment of the invention.

A transportable container according to one embodiment of the invention is generally indicated in the drawings by the reference numeral 20. Importantly, the container 20 is a unitary structure having a monocoque construction, i.e., it is a structure in which the skin carries all or a major part of the stresses imposed on the structure. More specifically, the container 20 does not have a conventional structural framework. Load and force induced stresses are distributed along three axis at right angles with respect to each other, i.e., along the side, end, roof, and floor panels of the structure. For example, a force applied to an upper corner of the container according to one embodiment of the invention is distributed along the side wall, end wall, and roof panels of the container 20. The wall, roof, and floor panels are reinforced by nonmetallic columns at the vertical corner edges and cooperate with the columns to provide the sole load bearing and force distributing elements of the structure.

Figure 7:
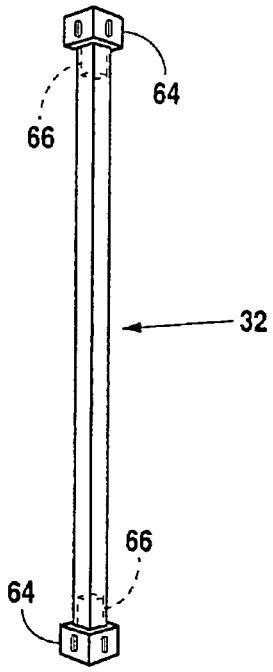
FIG. 7 is a perspective view of a column having ISO fittings attached at the top and bottom ends thereof and disposed in each of the vertical corners of the container according to one embodiment of the invention.
Figure 8:
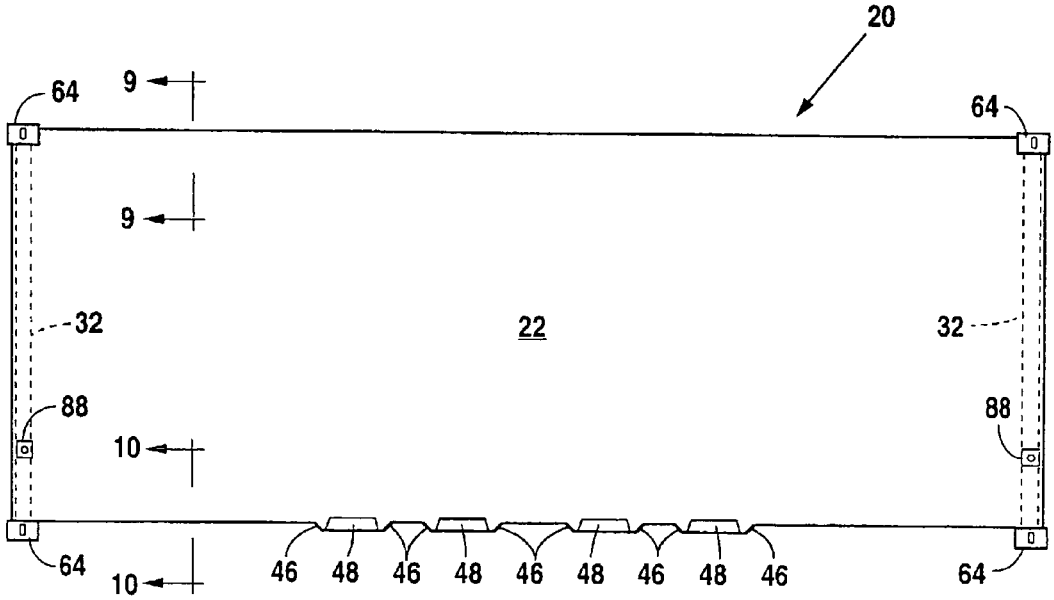
FIG. 8 is a side view of the nonremovable side wall arrangement of the container according to one embodiment of the invention.

The container 20 may have fixed side walls 22, as shown in FIG. 1, or side walls with a removable panel 24 detachably mounted in the side wall 22. In addition to the side walls 22, the container 20 also has an end wall 26 disposed at each end of the container, a roof panel 28, and a floor panel 30. A nonmetallic tubular column 32 (best shown in FIG. 7) is disposed in each vertical corner of the container 20. In the preferred embodiment of the invention, the container 20 has a rectangular shape. Other multiple-sided structures, such as triangular, hexagonal, octagonal, or other shapes, may also be built in accordance with the bonded panel construction according to one embodiment of the invention. Regardless of plan shape, an access door 34 is conveniently disposed in at least one wall 26 of the container 20 to provide an entryway into the interior of the container 20.

As shown in the drawings, the load bearing panels of the structure 20, i.e., the side wall panels 22, the end wall panels 26, the roof panel 28, and the floor panel 30, have a laminated composite construction, preferably formed of nonmetallic materials. Each of the composite panels has a lightweight foam core 36, preferably formed of a structural foam material. In the preferred embodiment, the foam cores 36 are formed of styrene acrylonitrile (SMA) linear structural foam having a density of about 4 pounds/cubic feet. Other structural foams that may be suitable for use in the invention include foam blends of styrene and other resins that are commonly used in the formation of building panels, automotive components, and similar products, such as styrene-maleic anhydride (SMA), polystyrene, polypropylene, polyurethane (thermoset), polyethylene, polyvinyl chloride, and acrylonitrile butadiene styrene. Also, lightweight naturally-occurring structural materials, such as balsa wood, may be used to form at least a portion of the cores 36. In the invention, the cores 36 are desirably formed of 1.25 inch thick foam sheets that are laminated together to provide a core of the desired thickness. Lamination between adjacent layers of the foam, and between built-up panels, is preferably carried out by placing a resin-impregnated, lightweight (e.g., ¾ oz.), fiberglass fabric 60 between the mating surfaces of the foam.

An external surface skin 38 is laminated to the outer surface of the core and an interior surface skin 40 is laminated onto the inner surface of the core 36. The surface skins 38, 40 are preferably formed of a nonmetallic material, such as fiberglass. In the preferred embodiment, the surface skins 38, 40 are formed of "E Grade" double biased fiberglass fabric having a weight of about 17 oz. Other fabrics that may be suitable for use in the surface skins 38, 40 include polyester and other organic fibers, other inorganic fibers such as carbon/graphite, metalized fabrics, and patented fiber fabrics, such as, for example, Kevlar™ polyamid fiber (DuPont). Preferably a polyester resin, or other resin system compatible with the skin fabric and core materials, is coated on, drawn into, extruded, or otherwise intimately introduced into the fabric that, upon hardening, cooperates with the fabric to form a rigid shell that is laminated, i.e., intimately bonded, with the core forming a single rigid structure.

Figure 4:
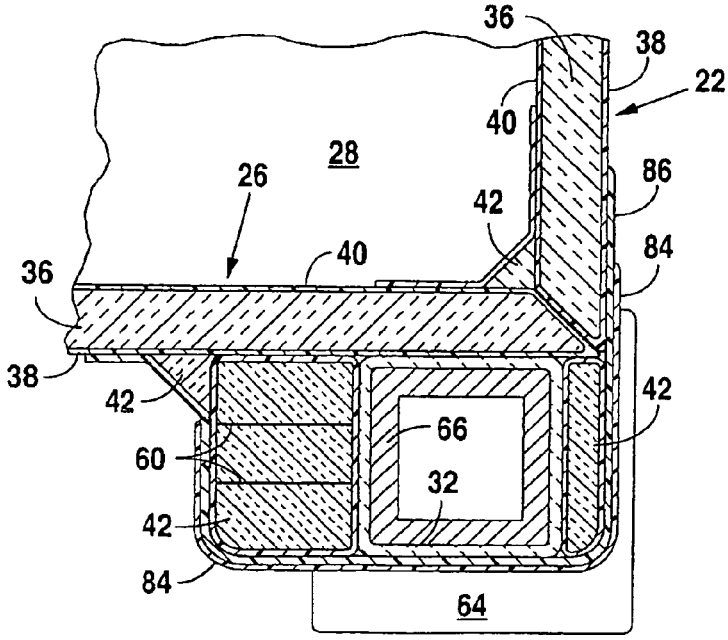
FIG. 4 is a cross-sectional view of one corner of the container taken along line 4-4 of FIG. 3.
Figure 12:
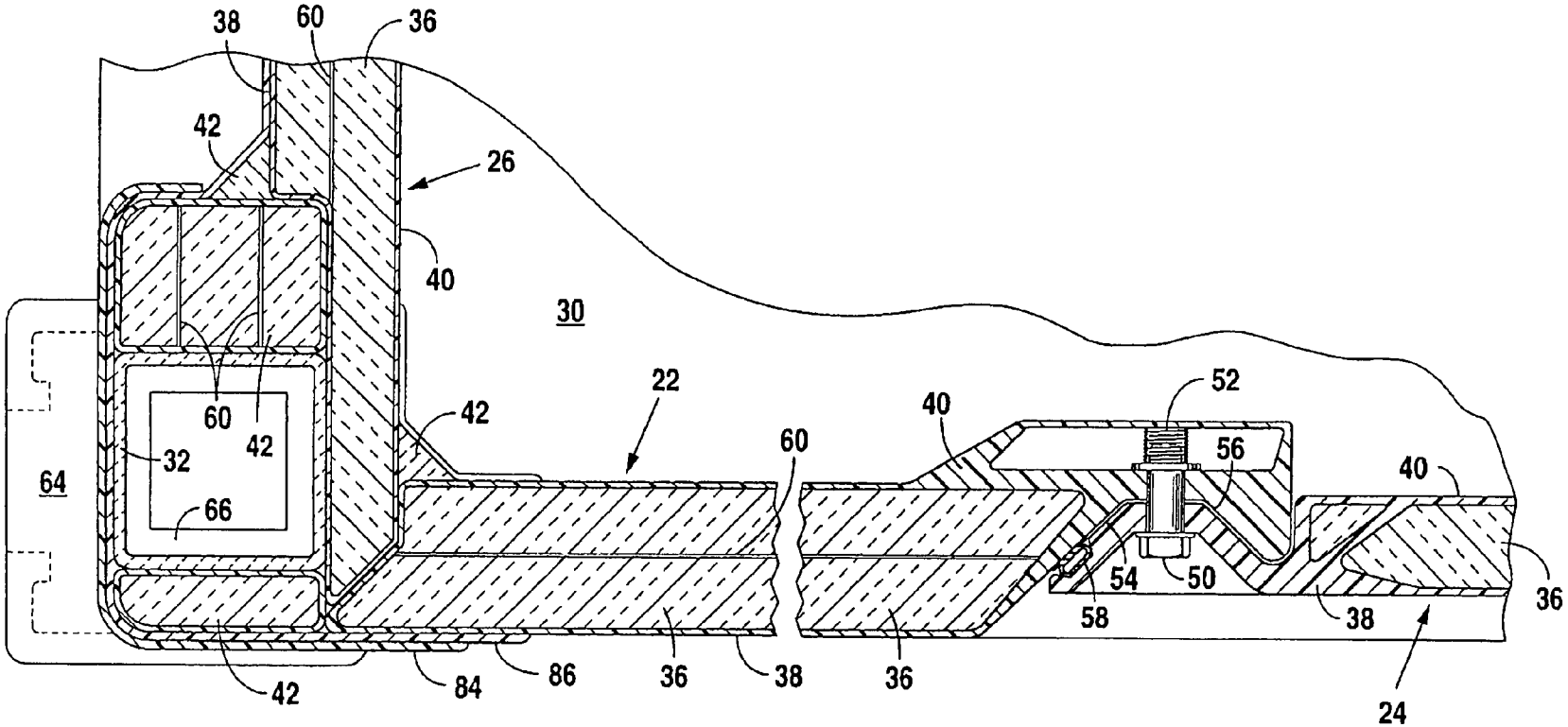
FIG. 12 is a cross-sectional view of the juncture between the side and end walls of the container taken along line 12-12 of FIG. 11.

Typically, the laminated end wall panels 26 have a thickness of about 1.25 inches. If it is desired to only stack the containers 20 six units high, the side walls 22, if not equipped with removable panels 24, may also be about 1.25 inches thick, as shown in FIG. 4. If it is desired to stack the units seven high, or to place removable panels 24 in the side walls 22 of the container 20, it is desirable to double the thickness of the side walls 22 and the end walls 26 to a thickness of 2.5 inches, as shown in FIG. 12. In either arrangement, a nonmetallic column 32 described below in greater detail, is integrally bonded into each vertical corner edge of the structure, as shown in FIGS. 4 and 12.

Figure 5:
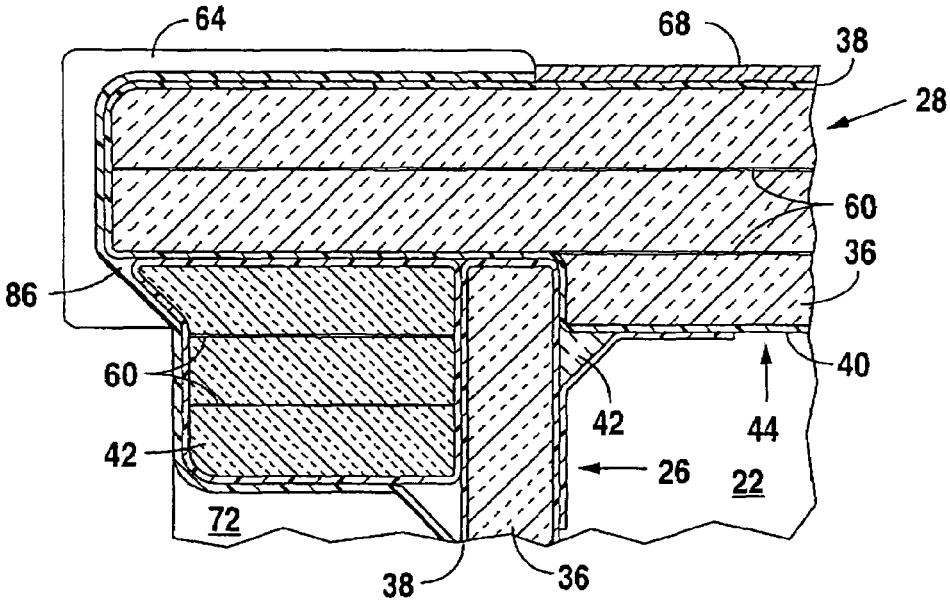
FIG. 5 is a cross-sectional view of the juncture of the roof and end wall panels of the container taken along line 5-5 of FIG. 3.
Figure 6:
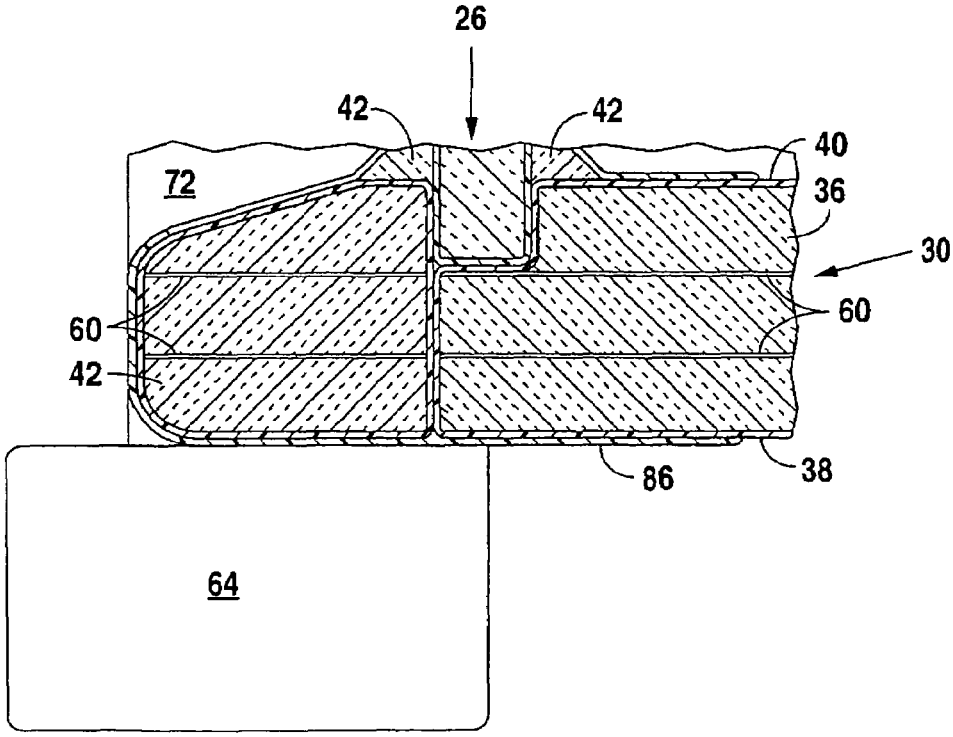
FIG. 6 is a cross-sectional view of the juncture between the floor and end panels of the container taken along line 6-6 of FIG. 3.
Figure 9:
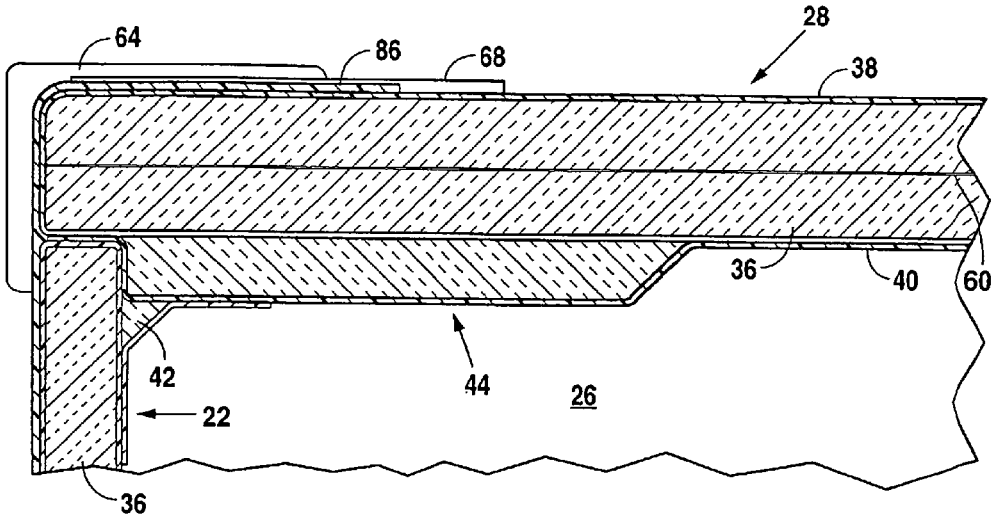
FIG. 9 is a cross-sectional view of the juncture of the roof and side wall panels of the container taken along line 9-9 of FIG. 8.
Figure 10:
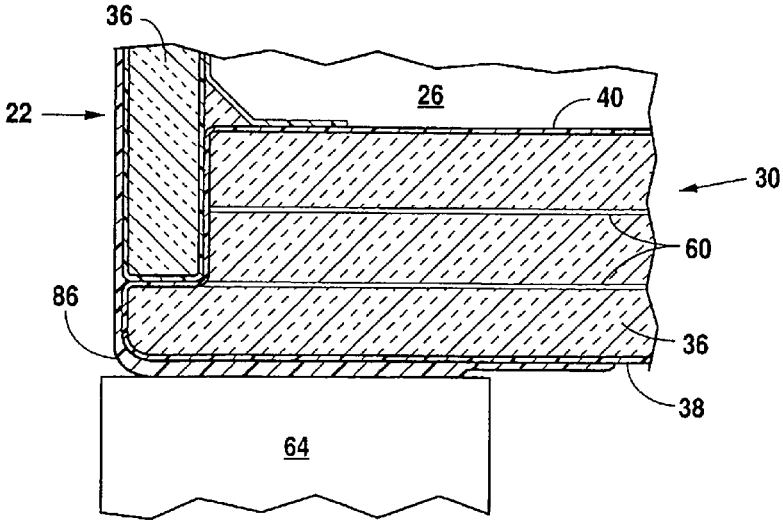
FIG. 10 is a cross-sectional view of the juncture of the floor and side wall panels of the container taken along line 10-10 of FIG. 8.
Figure 11:
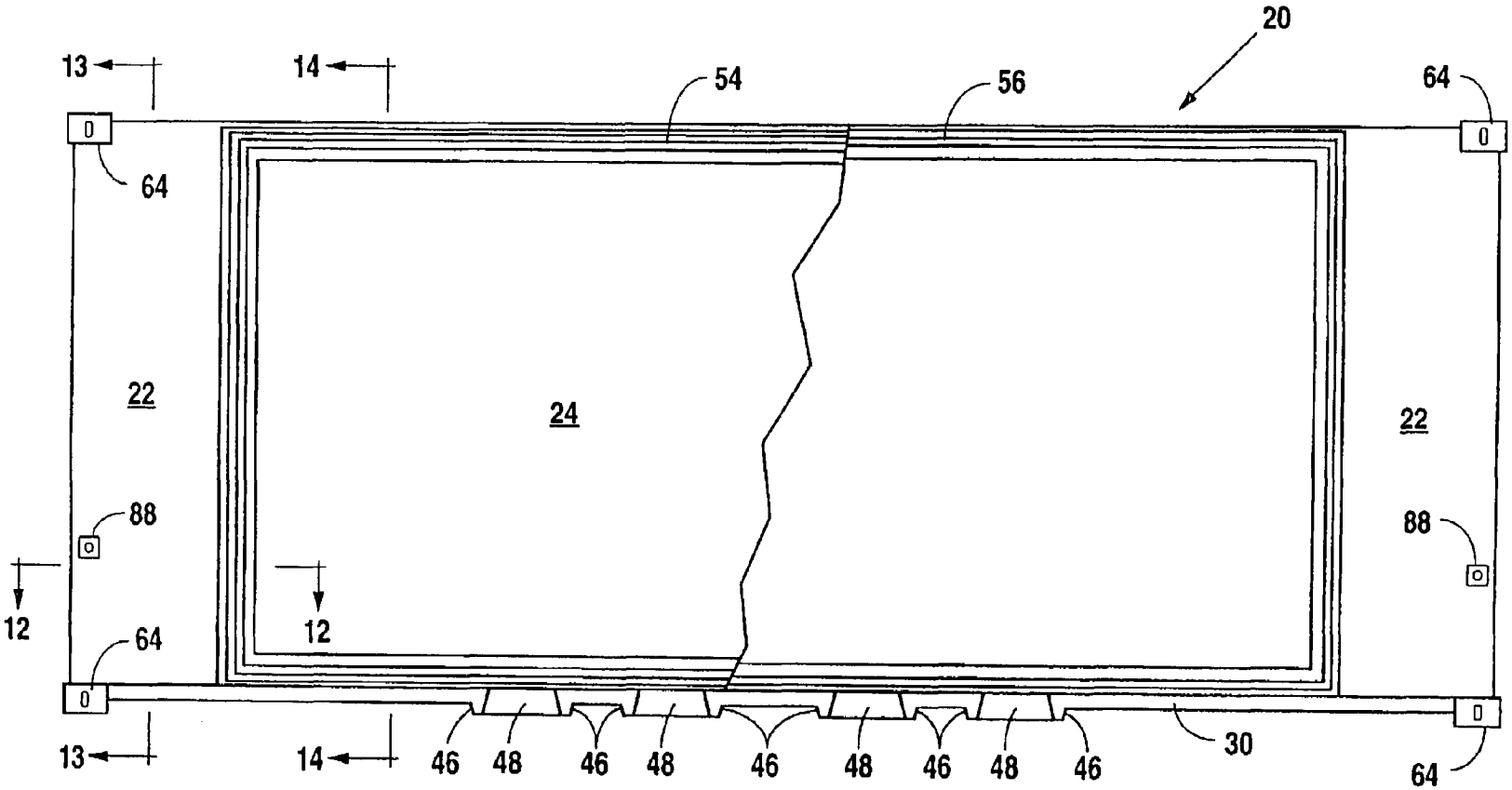
FIG. 11 is a side view of the container in which the side wall includes a removable panel, a portion of which is broken away to show the underlying groove in the side wall panel according to one embodiment of the invention.

In either arrangement, the roof panel 28 typically has a thickness of about 2.5 inches, with an additional 1.25 inches of the core material added in a region about 1 foot wide around the outer edges of the roof panel 28, forming a roughly 3.75 inch thick perimeter region 44 adjacent each of the end wall panels 26 (best shown in FIG. 5) and adjacent each of the side wall panels 22 (best shown in FIG. 9). In either the fixed or removable side panel arrangements, the floor panel 30 preferably is built up of three laminated layers of about 1.25 inch thick core sheets to provide a thickness of roughly 3.75 inches. The bottom surface of the floor panel 30 desirably has a plurality of ribs 46 extending transversely across the floor panel 30 that serve as stiffeners to better support cargo or other loads acting directly on the inner surface of the floor panel 30. Fork pockets 48 are conveniently formed between adjacent pairs of the ribs 46 for use in lifting the container 20 with forklift trucks.

Figure 13:
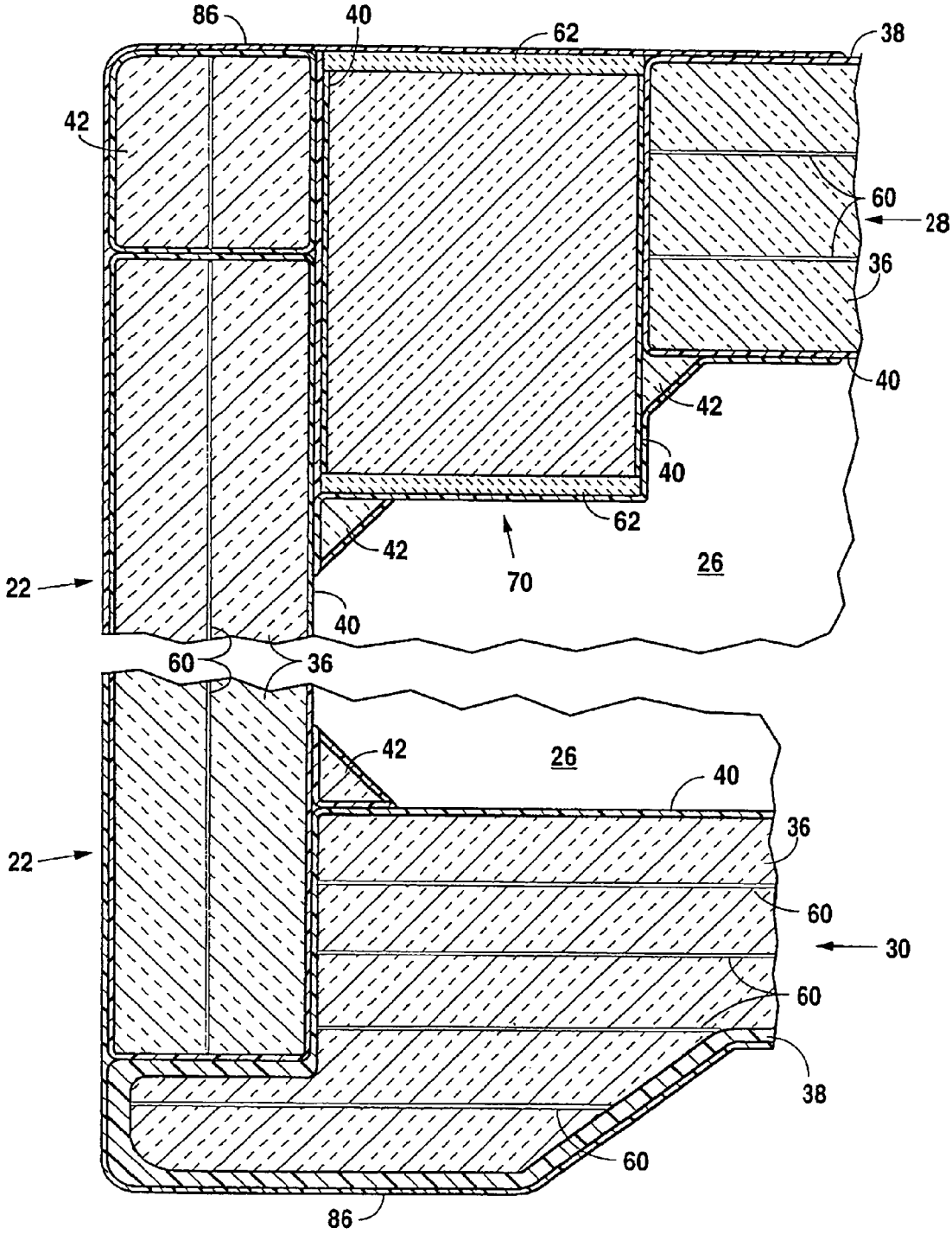
FIG. 13 is a cross-sectional view of the fixed side wall portion of the container taken along the line 13-13 of FIG. 11.
Figure 14:
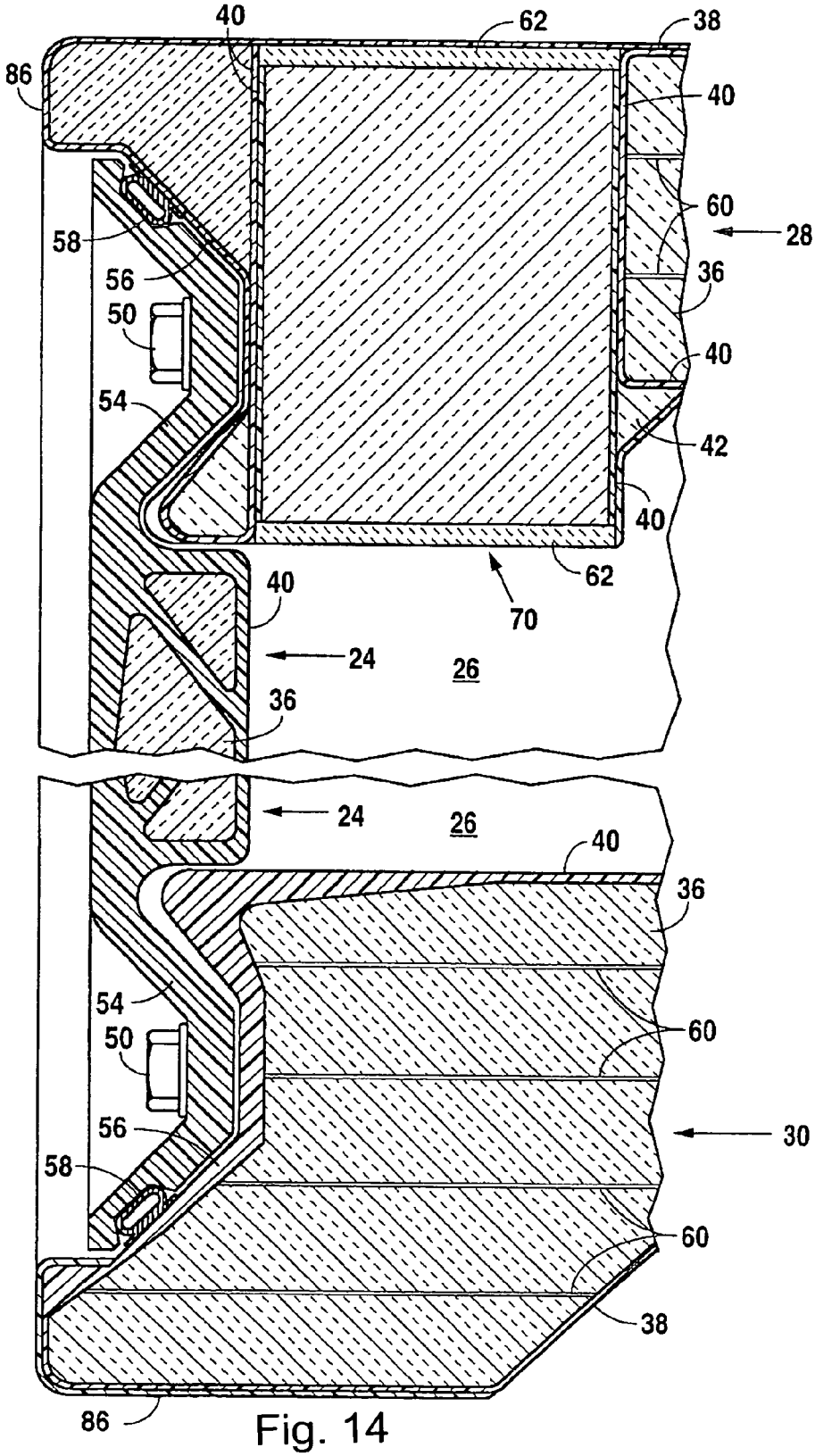
FIG. 14 is a cross-sectional view of the removable panel of the container taken along line 14-14 of FIG. 11.

In the arrangement of the container 20 having removable panels 24 detachably mounted to the fixed side walls 22, it is desirable to reinforce the side edge of the roof panel 28 adjacent the upper edge of the side wall 22. As shown in FIGS. 13 and 14, a thickened section 70 is bonded with the roof panel 28 and the upper edge of the side wall 22 along the length of the side wall 22. The thickened section 70 is advantageously formed by laminating a heavy (e.g., 20 oz wt.) stitched aligned carbon fabric to the top and bottom horizontal surfaces of an elongated rectangularly-shaped core preferably formed of the same material, i.e., a structural polymer foam, as used in the core of the wall, roof and floor panels. The core of the thickened section 70 may be a single piece as shown in the drawings, or built up of multiple laminated layers of, for example, 1.25 inch thick sheets. External fiberglass skins 40 are preferably laminated onto the vertical side surfaces of the thickened section 70.

The corner columns 32 are preferably mandrel-wound or extruded carbon/graphite composite hollow tube box sections measuring roughly 4 inches by 4 inches, with wall thickness of about 0.11 inch. If desired, the hollow interior of the tube may be filled with lightweight foam. Jacking attachment inserts 88 may be installed in each of the columns 32, as shown in the drawings, to provide an attachment point for leveling jacks.

Figure 15:
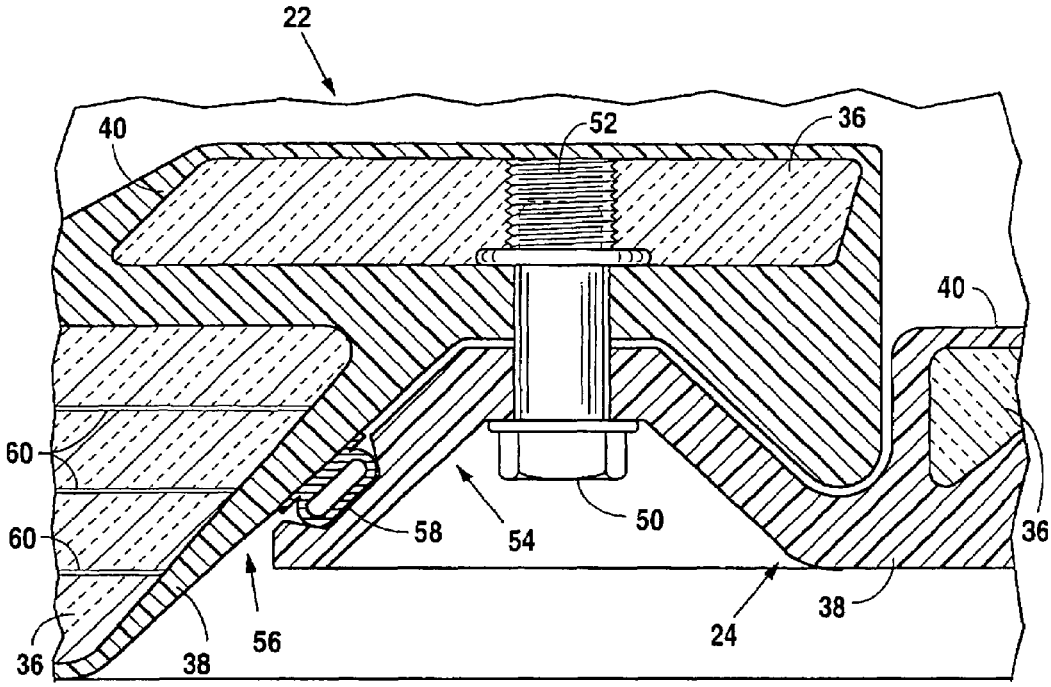
FIG. 15 is an enlarged cross-sectional view of the sealed groove arrangement for detachably mounting the removable panel to the fixed side wall of the container according to one embodiment of the invention.

The removable panels 24 are detachably mounted to the side panels 22 by a plurality of bolts 50, each of which threadably engages a nut retainer 52 embedded within the side panel 22, as shown in FIGS. 12 and 15. The removable panel 24 has a fiber reinforced plastic (FRP) flange 54 extending around the periphery of the panel 24 and mates with a similar FRP flange 56 formed in the perimeter of the opening in the side wall 22. The mutually engaging, mating configuration of the flanges 54, 56 enhances the ability of the fixed wall panel 22 to transfer stresses to the removable wall panel 24, thereby enabling structural loads imposed on the structure 20 to be transferred to the removable panel 24. A resiliently compressible seal 58 is disposed adjacent the peripheral edge of the flange 54. Thus, when the removable panel 24 is attached to the side wall 22 and the bolts 50 are tightened into the retainers 52, the flange 54 of the removable panel 24 is drawn toward the flange 56 of the fixed side wall 22 and the seal 58 is compressed between the flanges 54, 56, thereby sealing the joint between the flanges 54, 56.

Figure 16:
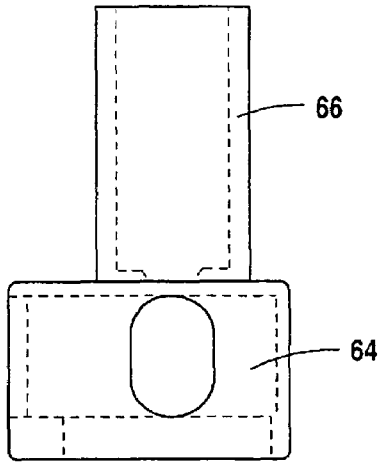
FIG. 16 is an elevational view of a conventional ISO fitting having an extension attached thereto that is adapted to be fixedly attached to each of the open ends of the vertical columns in the container according to one embodiment of the invention.

Advantageously, a conventional ISO fitting 64 is mounted on each of the eight corners of the container 20 to provide for the attachment of lifting hooks, tie downs, and alignment and coupling pins for attachment with other units when stacked one on top of the other. As best shown in FIG. 16, the ISO fitting 64 has a rectangular tubular extension 66 welded onto the base of the fitting 64. The extension 66 is rigidly bonded, such as by an epoxy adhesive, into each end of each of the nonmetallic columns 32.

ISO fittings are conventionally formed of steel or aluminum. However, if desired for stealth, i.e., reduced radar detection purposes, the ISO fittings 64 and extensions 66, as well as the bolts 50, retainers 52, the frame and hardware of the access door 34, and other hardware attachments, may be formed of polycarbonate or other high strength plastic material.

If desired, an aluminum or impact-resistant plastic plate 68 having a thickness of about ¼ inches, may be placed at each corner of the roof panel 28 adjacent each of the ISO fittings 64 and, if needed, in the center of the roof, to provide protection against impact by handling equipment hooks during hoisting of the container 20 by a crane or helicopter.

In some embodiments, instead of the conventional ISO fittings 64, removable ISO fittings may be used, such as the ISO fittings described in U.S. patent application Ser. No. 10/610,010, entitled "ISO Fittings for Composite Structures," filed Jun. 30, 2003, and incorporated herein by reference in its entirety. The removable ISO fittings may then be disengaged from the container 20 as needed, for example, to maintain and repair the ISO fittings.

Figure 17:
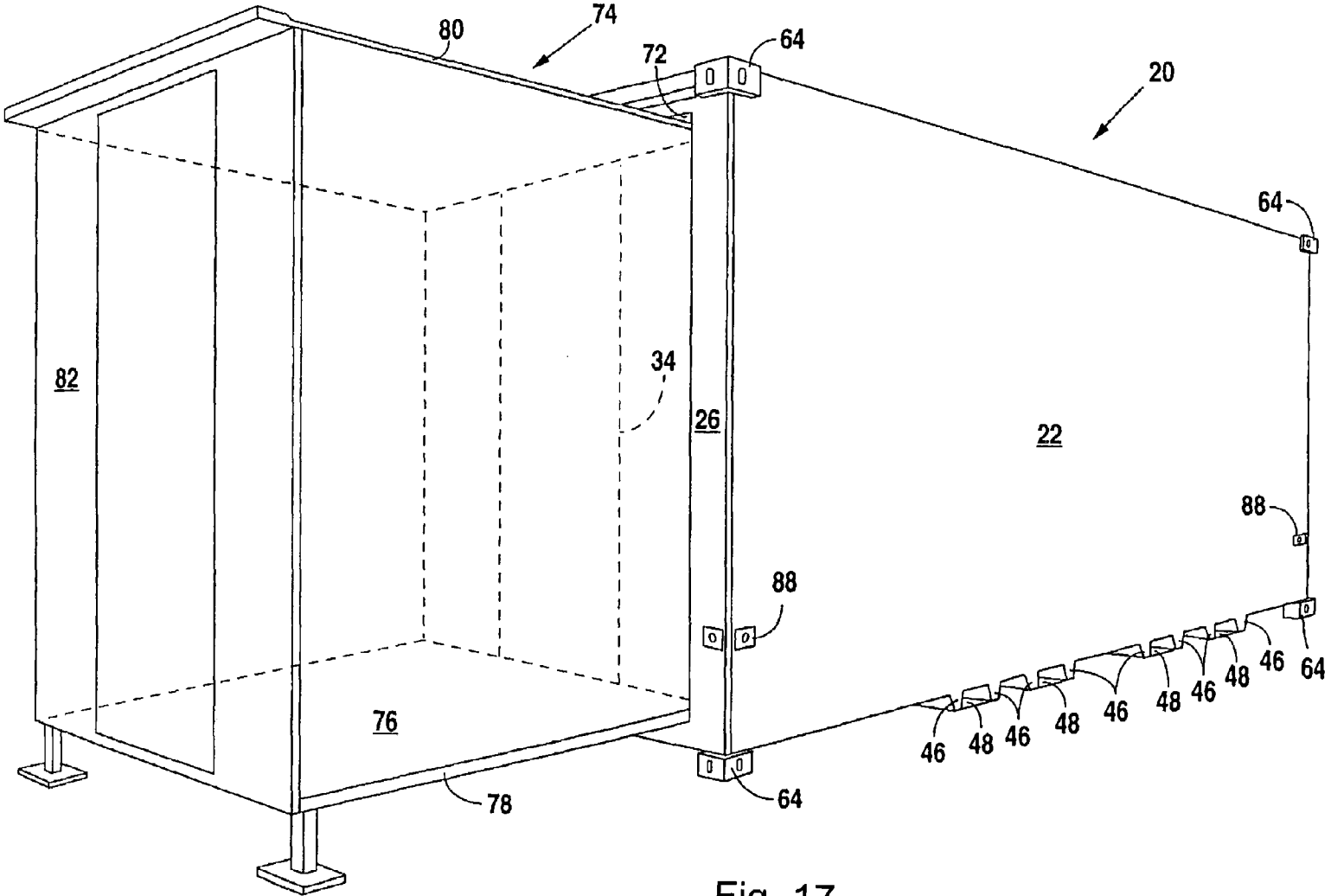
FIG. 17 is a perspective view of the container in which a foldable entryway is shown disposed at one end of the container according to one embodiment of the invention.

As may be seen in FIGS. 4, 5, 6, and 12, the corner columns 32 project outwardly from the end wall panels 26, forming a shallow cavity 72 that is defined by the inwardly stepped end wall 26 and each of the vertical corners at each side of the end wall. The cavity 72 advantageously provides a recess for a folding vestibule 74, shown in FIG. 17 in its extended, or deployed, position. The folding vestibule 74 includes a pair of side walls 76, a floor 78 and a roof 80, all of which are mounted by hinges to the end wall 26. An end wall 82 of the vestibule may be mounted by hinges to either the floor 78 or the roof 80. The end wall 82 has a door provided therein for access into the vestibule 74 and thence through the access door 34 into the interior of the container 20. The vestibule 74 is particularly convenient for use in storing tools and equipment not immediately needed in the container 20, for locating support equipment such as compressors and generators, or as a transition chamber between the interior of the container 20 and the environment external to the container 20.

As will be readily recognized by one skilled in the art of fabricating laminated structures, such as boat hulls and similar large reinforced plastic structures, the container 20 according to one embodiment of the invention may be conveniently constructed by using hand lay-up techniques in an open mold, or by conventional closed molds processes. In the hand lay-up process, a gelcoat is applied to mold surfaces that are shaped to define the exterior surface of one or more of the panels comprising the container 20. For example, the mold surface may define the exterior surface of the roof panel 28, one of the side panels 22, and one of the end wall panels 26. If desired, sand or a similar material may be placed in the gelcoat on the roof panel exterior surface to provide a slip-resistant surface on the roof panel 28.

An added layer of reinforcement fabric 84, preferably similar to the aforementioned double biased fiberglass fabric forming the laminated interior and exterior shins 38, 40 on the wall, roof and floor panels, is then deposited on top of the gelcoat. Desirably, the added layer of reinforcement fabric 84 covers around each of the eight corners of the container 20 and extends over a portion of each of the side panels, in FIGS. 4 and 12. In addition, another layer of fabric 86, which can serve as a doubler, extends along each joint between adjacently disposed panels of the container 20, as shown in FIGS. 4, 5, 6, 9, 10, 12, 13 and 14.

The previously described fabric component of the exterior surface skin 38 is then placed over the prepositioned reinforcement fabric layers 84 and 86 and coated with a suitable resin, such as a polyester resin. The foam cores 36 of the panels, either previously laminated together or built up in the mold, are then placed over the resin-impregnated fabric that forms the external surface skin 38. The corner columns 32 may be conveniently placed in each of the four corner edges of the structure along with any required fillers 42 that are desirably formed of the same material as the core 36 of the laminated panels or added after removal of the assembly from the mold. Also, if used, the thickened roof sections 70 may be positioned in the mold along the top edge of each of the side panels 22.

Lastly, corner fillers and other desired filler pieces 42 may be positioned prior to applying the fabric component of the interior surface skin 40 of the structure. The hand lay-up process is well known for forming laminated fiberglass-reinforced structures such as boat hulls, panels for transit cars, bathroom components, and architectural panels. Desirably, the hand lay-up process is carried out in association with vacuum bagging whereby the entire structure is encased within a plastic bag and a vacuum is applied to produce a negative pressure within the bag to pull the columns, cores and fabric skins together in intimate contact prior to hardening of the resin.

Other techniques suitable for forming the container 20 according to one embodiment of the invention include closed-mold molding in which a vacuum may be applied after closure of the mold to draw all of the structural foam core and fabric skin components into intimate contact with each other prior to hardening of the resin.

It is generally desirable to construct the container 20 in at least two separate subassemblies and then bond the two subassemblies together to form the single one piece structure. For example, as described above, the roof panel 28, one of the end walls 26, and one of the side walls 22 may be constructed in one operation, and the floor panel 30, the other one of the end walls 26, and the other side wall 22 formed in a separate operation. The two subassemblies are then bonded together to form the entire container 20.

For military applications, a metalized fabric may be incorporated into the laminated interior surface skin 40, the external surface skin 38, or even between laminated layers of the core 36, to provide RF (radio frequency) and EMF (electric and magnetic fields) shielding of equipment and occupants within the container 20. In a similar fashion, a ballistic resistant fabric such as Kevlar™ (DuPont) may be incorporated into the panels of the container 20 to provide ballistic protection. Furthermore, the reinforced plastic external surface skin 38 of the container 20 may comprise a radar-nonreflective material, i.e., material that either absorbs or does not reflect radar frequency electromagnetic energy, laminated with the core 36. In that arrangement, the container 20 is useful as a military command post that would be difficult to detect by radar. Because the container 20 has no joints other than around an entry door or a removable panel (which are easily sealed), the container 20 can be pressurized so that a positive pressure is maintained within the container 20. This feature is particularly useful in applications where it is desired to prevent the infiltration of hazardous, toxic, noxious, or other undesirable atmospheres, into the interior of the container 20, or for use in high altitude applications.

Importantly, it should be noted that the container 20 does not have a conventional frame. All of the components of the container 20 are laminated together to form a single rigid, unitary, monocoque structure in which the floor, roof and side panels, reinforced only by the vertical corner columns 32, carry all of the stresses imposed on the container 20. When constructed according to the above-described embodiment, the container 20 has an empty weight of about 2150 pounds and can be easily transported by helicopter or stacked up to seven units high for transport by container ship. As used herein, the terms "stacked" or "stackable" means being able to satisfy ISO and/or CSC standards and regulations for stacking containers. When stacked seven units high, the container 20 has sufficient strength to support a vertical load of roughly 20,000 pounds per container, i.e., a stacking load of roughly 120,000 pounds on the bottom container, as well as the transverse racking loads that are applied by the lashings and tie downs during rolling of the ship in high seas.

The floor 30 of each container 20 is capable of supporting a payload of roughly 17,500 pounds in the described 20-foot long, 8-foot wide, container. Thus, the container 20 is capable of carrying over eight times its tare weight of 2,150 pounds. In addition, when constructed according to the above-described embodiment, the container 20 is able to withstand winds of up to 100 mph (miles per hour), and the roof 28 of the container 20 is capable of supporting snow or sand loads of 100 psf (pounds per square foot). Thus, the container is also highly suitable for use in extreme weather conditions and hostile environments.

As can be seen from the foregoing, the container 20 according to one embodiment of the invention has important military and commercial uses. It is also lightweight, easily transportable by truck, rail, sea or air, and has a payload capacity in excess of 8 times its tare weight. The container 20 further has important inherent thermal insulating properties to protect equipment and personnel in the container from extreme external temperature or other adverse climatic conditions. The panels forming the sides, roof and floor of the container 20 can be constructed to provide a barrier to the passage of electromagnetic energy signals and be non-reflective of radar signals. Also, since the container 20 has no open joints between any of the wall, roof or floor panels, it is easily pressurizeable for important military or high altitude applications.

In addition, the container 20 can be stacked up to seven units high to facilitate transporting of same. When structures of any kind are stacked, however, there is a risk that the structures will tip or fall over, or that they will become warped or deformed, due to the forces acting on the structures during loading/unloading and shipping, especially by boats and trains. For this reason, the shipping industry has strict requirements (e.g., ISO Standards 668-1976, 1496-1, 1161-1, and the like) related to the stacking of certain industry size-compliant containers, like the container 20 of the present invention. In order for a container to be certified as "stackable," the containers must first pass a series of structural loading tests, usually administered by the U.S. Coast Guard. For example, one of the tests is a column loading test where a structural load is placed on each column of the container individually. Another test is a transverse racking test where the bottom corners of the container are anchored and a force is applied to the top corners of the container in different lateral directions.

As alluded to above, conventional containers have metal frames that bear the bulk of any structural loads. The distribution of the loads for these containers is therefore generally along the metal framework. As a result, appropriate measures (e.g., reinforcing the metal columns and beams) may be taken if needed to complete the certification of the containers. For structures like the container 20 that have a monocoque construction, however, the structural loads are distributed along the skin of the structure instead of the frame. Thus, for nonmetallic composite material structures, such as the container 20, the structural loads are distributed along the side wall 22, end wall 26, roof 28, and/or floor panels 30. Because of this dispersed load distribution, nonmetallic composite material structures have had difficulty in the past passing some of the more demanding ISO and other industry standard stackability tests.

Figure 18:
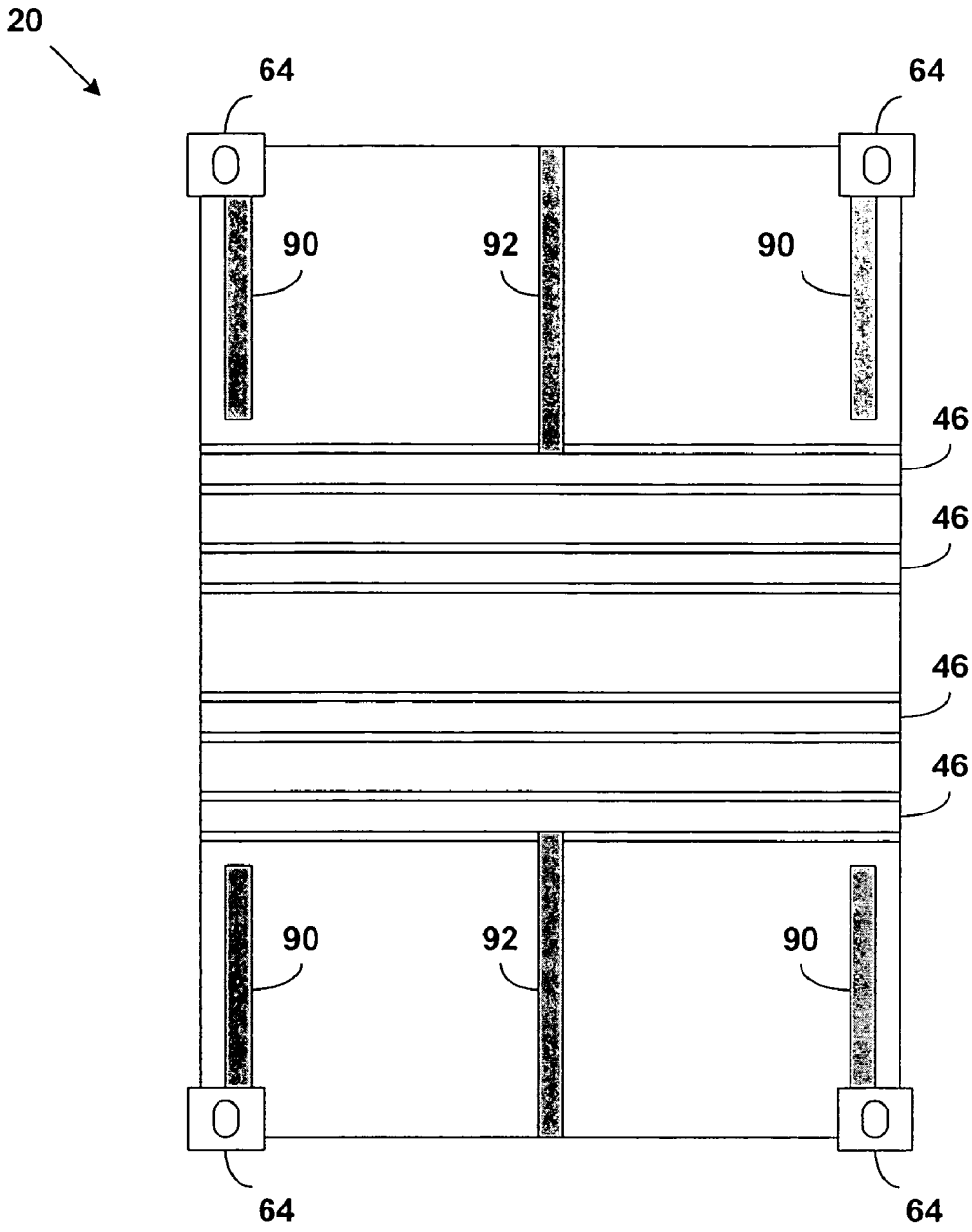
FIG. 18 is bottom view showing the floor panel of the container having floor stiffeners attached thereto according to one embodiment of the invention.

Referring now to FIG. 18, in accordance with embodiments of the invention, floor stiffeners may be attached to the bottom surface of the floor panel 30 to help fortify the floor panel 30 against twisting and/or flexing that may occur during certification testing (ISO, CSC, etc.). In one embodiment, the floor stiffeners may include a plurality of edge stiffeners 90 and a plurality of mid-floor stiffeners 92. These floor edge stiffeners 90 and mid-floor stiffeners 92 may be attached to the floor panel 30 via any suitable means, including adhesive, one or more bonded layers of composite material, and the like.

In the particular embodiment shown here, there are four edge stiffeners 90 (corresponding to the four corners of the floor panel 30) and two mid-floor stiffeners 92. The edge stiffeners 90 extend lengthwise from the corners of the floor panel 30 substantially parallel to the long edge of the floor panel 30 toward the ribs 46. In one implementation, the edge stiffeners 90 abut the ISO fittings 64 at each corner of the floor panel 30, although it is not absolutely necessary for them to do so. The mid-floor stiffeners 92 also extend lengthwise in the same direction as the edge stiffeners 90, but down the middle portion of the floor panel 30 instead of along the long edge. Thus, each mid-floor stiffener 92 is disposed between two edge stiffeners 90, typically about halfway between the two edge stiffeners 90. Both the edge stiffeners 90 and the mid-floor stiffeners 92 may extend to the ribs 46, and in the case of the mid-floor stiffeners 92, may even touch the ribs 46.

Note that although only four edge stiffeners 90 and two mid-floor stiffeners 92 are shown and described in FIG. 18, a person of ordinary skill in the art will recognize that a different number of edge stiffeners 90 and/or mid-floor stiffeners 92 may certainly be used without departing from the scope of the invention.

Figure 19A:
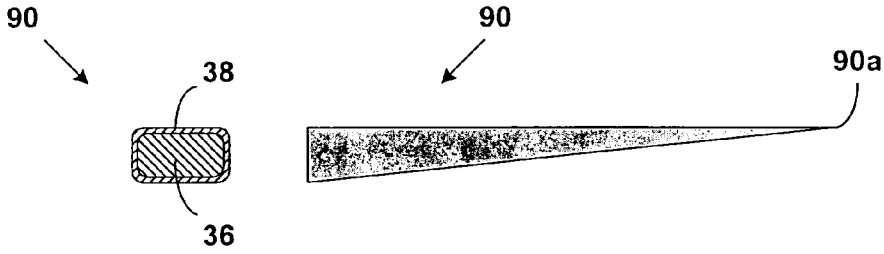
FIGS. 19A-B are cross-sectional and side views of the floor stiffeners shown in FIG. 18.
Figure 19B:
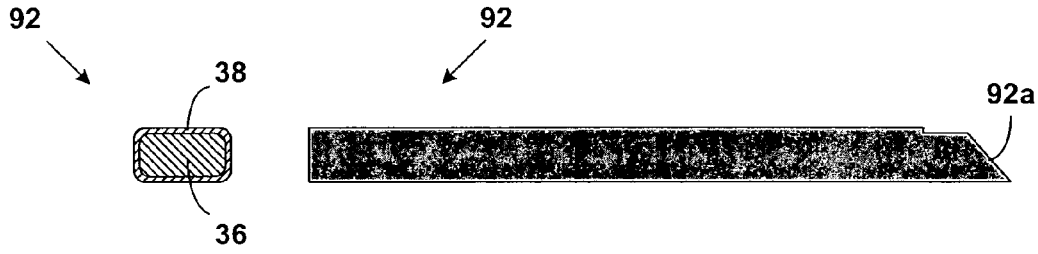

FIGS. 19A-B illustrate a cross-sectional view and a side view of the edge stiffeners 90 and the mid-floor stiffeners 92, respectively, according to one embodiment. As can be seen from the cross-sectional view, both the edge stiffeners 90 and the mid-floor stiffeners 92 may be made of a nonmetallic composite material, including an external fiberglass or carbon fiber skin similar to the skin 38 mentioned above laminated around a foam core similar to the form core 36 mentioned above. They may also have the same height (e.g., 4.3 inches) and width (e.g., 8.5 inches), although the mid-floor stiffeners 92 may be slightly longer than the edge stiffeners 90 (e.g., 65.9 inches versus 53.9 inches).

As can be seen from the side view, in one embodiment, the edge stiffeners 90 may be tapered at one end, namely, the end 90*a* toward the ribs 46. It is believed that any twisting and/or flexing along the long edge of the floor panel 30 becomes less pronounced towards the ribs 46. As such, the edge stiffeners 90 may be tapered (e.g., 4.9 degrees) toward the ribs 46 to reduce the amount of composite material used, since less reinforcement is needed in that area. The mid-floor stiffeners 92 have not been tapered, however, since no lessening of the twisting and/or flexing in that area has been observed. Nevertheless, in some embodiments, even the end 92*a* of the mid-floor stiffeners 92 may be tapered at the point where they meet the ribs 46 (e.g., 45 degrees) to conform the mid-floor stiffeners 92 to the angled shape of the ribs 46.

Figure 20:
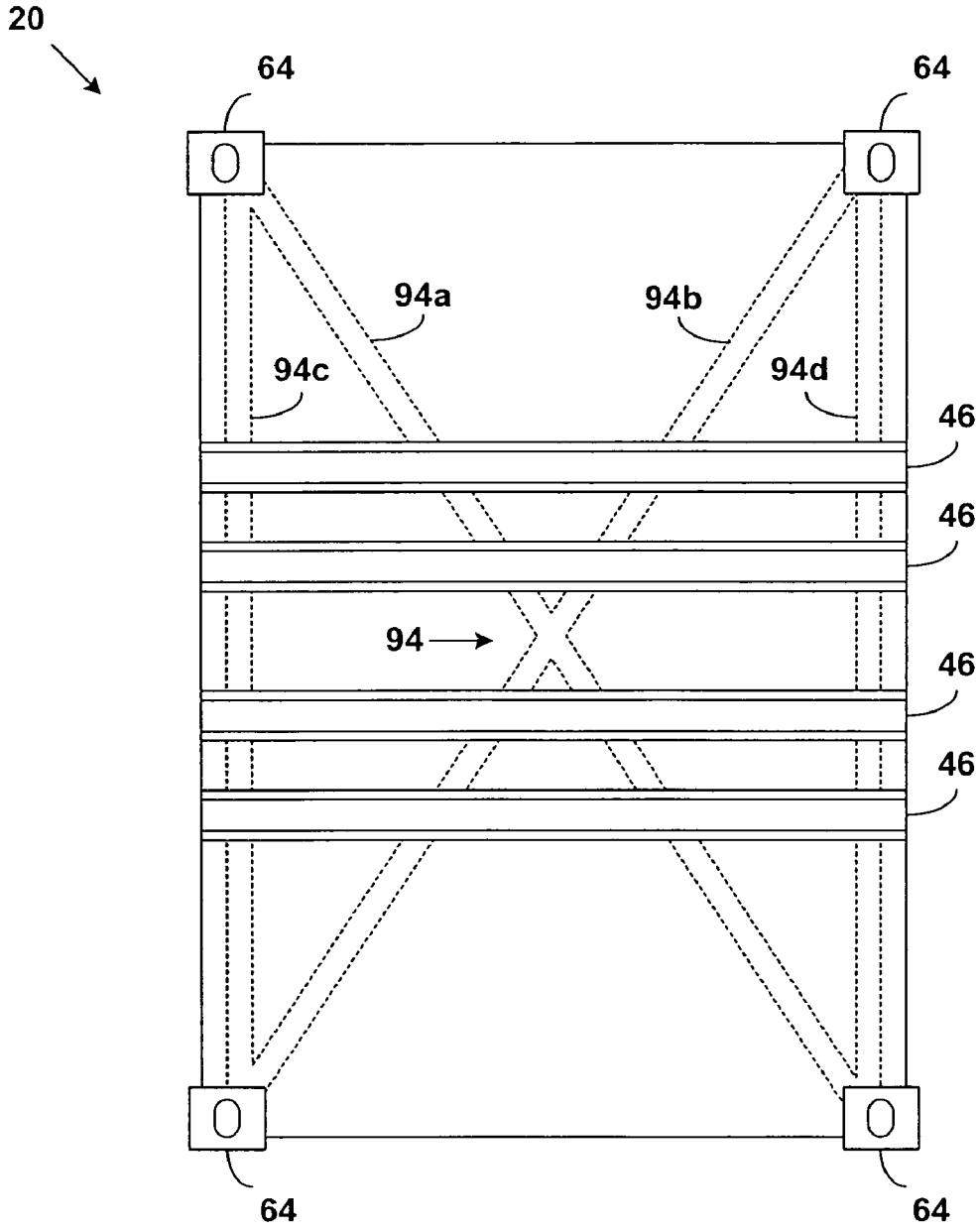
FIG. 20 is a bottom view showing the floor panel of the container having a floor brace attached therein according to one embodiment of the invention.

In addition to (or instead of) the edge stiffeners 90 and mid-floor stiffeners 92, a floor brace may also be inserted into the floor panel 30. FIG. 20 illustrates one example of such a floor brace 94, with the stiffeners 90 and 92 omitted here in order to not obscure the floor brace 94. The floor brace 94 it is disposed on the interior of the floor panel 30 (hence, the dotted lines) and serves to further reinforce the floor panel 30 against twisting and/or flexing. In one embodiment, the floor brace 94 may be a substantially flat piece having several constituent components, including two diagonal members 94*a* and 94*b* and two parallel members 94*c* and 94*d*. Each diagonal member 94*a*, 94*b* extends between diagonally opposed corners of the floor panel 30, thus criss-crossing one another to form an "X" within the floor panel 30. The parallel members 94*c* and 94*d*, on the other hand, do not cross because they extend between adjacent corners of the floor panel 30 along the long edges thereof. Other shapes besides a criss-crossing "X" shape may be used by those having ordinary skill in the art without departing from the scope of the invention.

In one embodiment, floor brace 94 may be formed as a unitary piece. In other embodiments, the floor brace 94 may be made of several separate components 94*a*, 94*b*, 94*c*, and 94*d* that are then attached to one another using any suitable means. Whether a unitary piece or as separate components, the floor brace 94 is preferably made of a nonmetallic composite material, for example, a fiberglass or carbon fiber material.

Although the constituent components 94*a*, 94*b* and 94*c*, 94*d* may have different lengths and/or widths, the floor brace 94 preferably has an overall length and width that allows the floor brace 94 to substantially extend the entire floor panel 30, reaching to all four corners thereof. For example, the floor brace 94 may have a length of 221 inches and a width of 90 inches, which is sufficient for the floor brace to extend to all four corners.

To attach, preferably the floor brace 94 is disposed either between the layers of foam in the foam core 36, or between the foam core 36 and the external skin 38, during fabrication of the floor panel 30. In one embodiment, foam pads (not expressly shown) may be placed at the corners of the floor panel 30 for receiving the four ends of the floor brace 94. If used, the foam pads preferably have recessed sections cut out of them to receive the ends of the floor brace 94. Then, composite material load distribution plates (not expressly shown) may be placed over and under each foam pad to sandwich the foam pads and the ends of the floor brace 94, thereby anchoring the floor brace 94 to the floor panel 30. Preferably, the foam pads and the load distribution plates have a rectangular shape and are of approximately the same size. Once the floor panel 30 is constructed, the floor brace 94 will not be visible to the unaided view. It is possible, however, to deploy the floor brace 94 on the outer surface of the external skin 38 without departing from the scope of the invention.

Figure 21A:
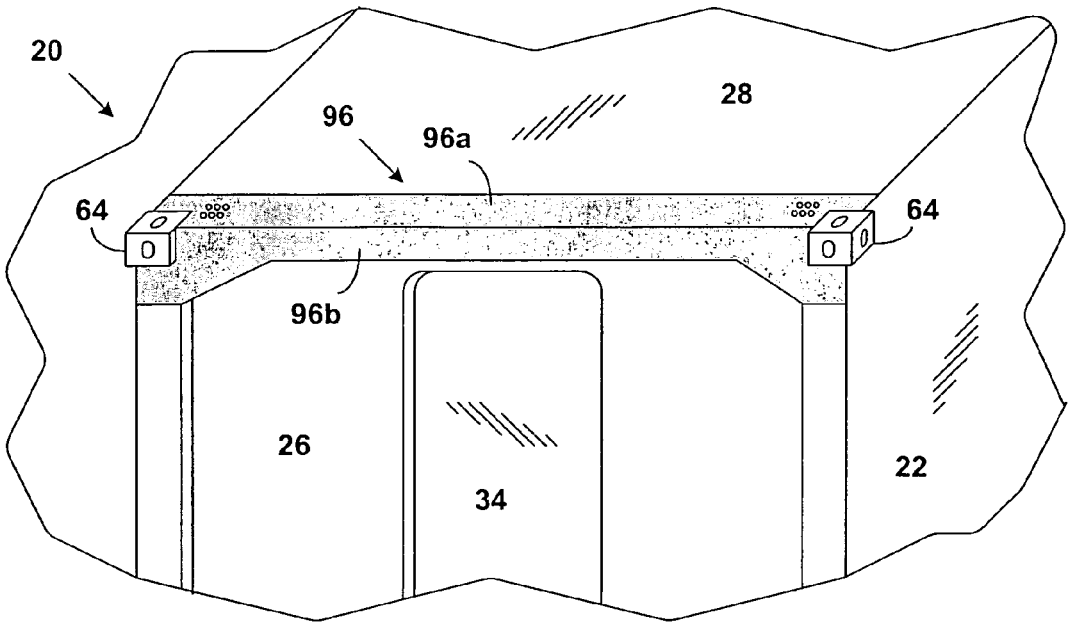
FIGS. 21A-B are partial perspective and side views of the container having a roof brace mounted thereon according to one embodiment of the invention.
Figure 21B:
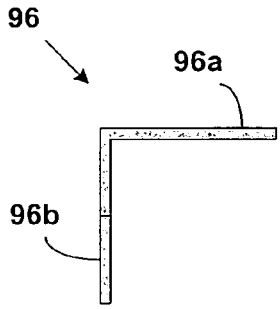

Furthermore, in some embodiments, a roof brace may be applied to the container 20 to further strengthen the container 20 from any twisting that may occur and also to provide protection for the container 20 from routine physical contact by logistics handling equipment (e.g., a crane). FIGS. 21A-B illustrate an exemplary roof brace 96 that may be attached to the roof panel 28 and the front wall 26 of the container 20, according to one embodiment of the invention. Although not visible here, a similar roof brace 96 may also be attached to the roof panel 28 and the rear wall, for a total of two roof braces 96. It is also possible to apply similar roof braces 96 to the roof panel 28 and the side walls 22, either alone or in conjunction with the front and rear wall braces 96.

As can be seen, the roof brace 96 extends between the two corners common to the front wall 26 and the roof panel 28. There are two main components: a roof component 96*a* and a front wall component 96*b* (the rear wall component is not visible here). Preferably, the two components 96*a* and 96*b* are made of a lightweight material, such as aluminum or other similar materials that can be provided in sheet form. The roof and front wall components 96*a* and 96*b* may then be formed as a unitary piece or as two separate pieces connected (e.g., welded) together. In either case, the roof and front wall components 96*a* and 96*b* together form a substantially L-shaped cross-section, as seen in FIG. 21B. Exemplary dimensions include a length of approximately 94 inches for both components 96*a* and 96*b* and a width of approximately 16 inches and 9 inches, respectively, for the roof component 96*a* and the front wall component 96*b*.

To attach, the roof brace 96 is disposed so that the roof component 96*a* and the front wall component 96*b* are flushed against their respective surfaces. Adhesives may then be used to secure the roof brace 96 to the front wall 26 and the roof panel 28. In some embodiments, a rectangular section may be cut out of both the roof component 96*a* and the front wall component 96*b* at the ends to thereof to accommodate the two ISO fittings 64 at the corners of the container 20. Similarly, a section may be cut out of the front wall component 96*a* to accommodate the opening and closing of the door 34. The particular shape of the cut-out section, however, is not overly important to the practice of the invention.

While the invention has been described with reference to one or more particular embodiments, those skilled in the art will recognize that many changes may be made thereto without departing from the invention. For example, it should be clear that changes in the suggested nonmetalic materials and methods of construction may be made without departing from the invention. In addition, although the foregoing embodiments were discussed as being stackable up to seven units high, a number of improvements are available, including the use of unidirectional carbon fiber material to make the various wall, roof, and/or floor panels thinner, for allowing the container of the invention to be stacked up to nine units high while still meeting various container stacking standards and regulations. Such changes are intended to fall within the scope of the following claims.

What is claimed is:

1. A monocoque shipping container having a predetermined height, width, and length, comprising:

a plurality of nonmetallic columns having a length substantially equal to said height of said container;

a plurality of nonmetallic composite material wall panels, each wall panel having a bottom edge and a top edge extending between a first vertical end and a second vertical end, each vertical end integrally bonded to one of said nonmetallic columns;

a nonmetallic composite material floor panel having a plurality of edges intersecting at predefined corners, each of said edges being respectively integrally bonded with said bottom edge of separate nonmetallic composite material wall panels, and each of said predefined corners being respectively integrally bonded with separate nonmetallic columns; and a nonmetallic composite material roof panel having a plurality of edges intersecting at predefined corners, each of said edges being respectively integrally bonded with said top edge of separate nonmetallic composite material wall panels, and each of said predefined corners being respectively integrally bonded with separate nonmetallic columns;

wherein at least one of said nonmetallic wall panels includes a panel section that is selectively removable from said wall panel, and said roof panel includes a thickened section extending along said entire length of an edge of said roof panel adjacent said top edge of said nonmetallic wall panel having said removable panel section, said thickened section being disposed within said roof panel in integrally bonded relationship therewith; and wherein said monocoque shipping container is capable of satisfying shipping industry standard requirements for stackability.

2. The monocoque shipping container according to claim 1, wherein said container has a solid rectangular shape in which said length is greater than said width, said plurality of wall panels include two side panels extending along said length of each side of said container and two end panels extending across said width at each end of said container, and said plurality of nonmetallic columns comprise four columns each of which is integrally bonded to a respective end of one of said side panels and to a respective end of one of said end panels, said nonmetallic columns and nonmetallic composite material side, end, floor and roof panels cooperating to form a rigid monocoque structure wherein resistance to vertically and transversely applied forces is distributed between said side, end, top and floor panels of said container.

3. The monocoque shipping container according to claim 1, wherein said nonmetallic columns are hollow square columns formed of a tubular material having a carbon/graphite composition.

4. The monocoque shipping container according to claim 1, wherein each of said nonmetallic columns have hollow first and second end portions spaced apart by a distance equal to said length of said columns, and said container includes a plurality of ISO fittings each having an extension adapted for insertion in a hollow end portion of said nonmetallic columns, each of said ISO fittings being disposed in a respective one of said hollow first and second end portions of each of said nonmetallic columns and integrally bonded therewith.

5. The monocoque shipping container according to claim 1, wherein each of said nonmetallic composite material wall, floor, and roof panels comprise a core formed of rigid structural foam having at least two planar surfaces, and a reinforced plastic skin formed of resin-impregnated woven fabric disposed on each of said planar surfaces of said core and forming a composite material structure therewith.

6. The monocoque shipping container according to claim 1, wherein said floor panel has an upper planar surface adapted to support a cargo load disposed thereon, and a lower surface characterized by a plurality of paired rib structures extending transversely across said lower surface between spaced side edges of said floor panel and in an direction outwardly from said lower surface whereby each of said paired rib structures define said side surfaces of an elongated channel adapted to receive a moveable fork of a forklift transport vehicle.

7. The monocoque shipping container according to claim 1, wherein each of said nonmetallic composite material wall panels has a core formed of structural foam and at least one reinforced plastic surface comprising a resin-impregnated ballistic-resistant woven fabric composite material with said core.

8. The monocoque shipping container according to claim 1, wherein each of said composite material wall, floor, and roof panels have a core formed of structural foam and a reinforced plastic surface comprising a radar-nonreflective material composite material with said core.

9. The monocoque shipping container according to claim 1, further comprising a plurality of floor stiffeners mounted to said floor panel for reinforcing said floor panel against twisting and/or flexing.

10. The monocoque shipping container according to claim 9, wherein said floor stiffeners comprise nonmetallic composite material rectangular tubes mounted externally to said floor panel.

11. The monocoque shipping container according to claim 9, wherein said floor stiffeners include edge stiffeners extending lengthwise from each corner of said floor panel along a long edge of said floor panel and parallel to said long edge.

12. The monocoque shipping container according to claim 9, wherein said floor stiffeners further include mid-floor stiffeners extending lengthwise from each short edge of said floor panel parallel to said long edge, each mid-floor stiffener disposed substantially halfway between two edge stiffeners.

13. A monocoque shipping container having a predetermined height, width, and length, comprising:

a plurality of nonmetallic columns having a length substantially equal to said height of said container;

a plurality of nonmetallic composite material wall panels, each wall panel having a bottom edge and a top edge extending between a first vertical end and a second vertical end, each vertical end integrally bonded to one of said nonmetallic columns;

a nonmetallic composite material floor panel having a plurality of edges intersecting at predefined corners, each of said edges being respectively integrally bonded with said bottom edge of separate nonmetallic composite material wall panels, and each of said predefined corners being respectively integrally bonded with separate nonmetallic columns;

a nonmetallic composite material roof panel having a plurality of edges intersecting at predefined corners, each of said edges being respectively integrally bonded with said top edge of separate nonmetallic composite material wall panels, and each of said predefined corners being respectively integrally bonded with separate nonmetallic columns; and a floor brace mounted within said floor panel for reinforcing said floor panel against twisting and/or flexing;

wherein said floor brace comprises parallel members extending between adjacent ones of said corners along a long edge of said floor panel and diagonal members extending between diagonally opposing ones of said corners; and wherein said monocoque shipping container is capable of satisfying shipping industry standard requirements for stackability.

14. The monocoque shipping container according to claim 13, wherein said floor brace is made of a lightweight material, including aluminum.

15. The monocoque shipping container according to claim 1, further comprising a roof brace mounted to said roof panel and one of said wall panels externally to said container for reinforcing said container against twisting and/or flexing and to protect said container against physical handling by logistics handling equipment.

16. A monocoque shipping container designed to withstand application of numerous forces in various directions in connection with industry standard stackability testing, comprising:

floor stiffeners mounted to a floor of said monocoque shipping container externally to said shipping container;

a floor brace mounted within said floor of said monocoque shipping container; and a roof brace mounted externally to a roof and an end wall of said monocoque shipping container;

wherein said floor stiffeners, said floor brace, and said roof brace provide reinforcement for said monocoque shipping container against twisting and/or flexing during said industry standard stackability testing; and wherein said floor brace comprises parallel members extending between adjacent corners of said floor along a long edge of said floor and diagonal members extending between diagonally opposing corners of said floor.

17. The shipping container according to claim 16, wherein said floor stiffeners comprise nonmetallic laminated rectangular tubes.

18. The shipping container according to claim 16, wherein said floor stiffeners include edge stiffeners extending lengthwise from each corner of said floor along a long edge of said floor and parallel to said long edge.

19. The shipping container according to claim 16, wherein said floor stiffeners further include mid-floor stiffeners extending lengthwise from each short edge of said floor parallel to said long edge, each mid-floor stiffener disposed substantially halfway between two edge stiffeners.

20. The shipping container according to claim 16, wherein said roof brace comprises a roof component extending between adjacent corners of said roof along a selected edge of said roof and an end wall component extending between adjacent corners of said end wall along a top edge of said end wall.

* * * * *